United States Patent [19]

Nakane et al.

[11] Patent Number: 4,632,311

[45] **Date of Patent: * Dec. 30, 1986**

[54] ATOMIZING APPARATUS EMPLOYING A CAPACITIVE PIEZOELECTRIC TRANSDUCER

[75] Inventors: Shinichi Nakane, Yamatokoriyama; Naoyoshi Maehara; Kazushi Yamamoto, both of Nara, Japan

[73] Assignee: Matsushita Electric Industrial Co., Ltd., Japan

[ * ] Notice: The portion of the term of this patent subsequent to Aug. 12, 2003 has been disclaimed.

[21] Appl. No.: 563,522

[22] Filed: Dec. 20, 1983

[30] Foreign Application Priority Data

| | | | |
|---|---|---|---|
| Dec. 20, 1982 | [JP] | Japan | 57-224259 |
| Dec. 20, 1982 | [JP] | Japan | 57-224266 |
| Jan. 18, 1983 | [JP] | Japan | 58-6322 |
| Feb. 22, 1983 | [JP] | Japan | 58-27929 |
| Sep. 2, 1983 | [JP] | Japan | 58-162225 |

[51] Int. Cl.[4] ..... B05B 3/14

[52] U.S. Cl. ..... 239/101; 239/102.1; 310/316

[58] Field of Search ..... 239/101, 102, 4; 310/316

[56] References Cited

U.S. PATENT DOCUMENTS

| | | | |
|---|---|---|---|
| 3,738,574 | 6/1973 | Guntersdorfer et al. | 239/102 |
| 3,747,120 | 7/1973 | Stemme | 346/75 |
| 4,156,157 | 5/1979 | Mabille | 310/316 |
| 4,223,242 | 7/1980 | Redlich et al. | 310/316 |
| 4,277,258 | 7/1981 | Mishiro | 310/316 X |
| 4,445,064 | 4/1984 | Bullis | 310/316 |
| 4,468,581 | 8/1984 | Okada et al. | 310/316 |

*Primary Examiner*—Joseph F. Peters, Jr.
*Assistant Examiner*—Kevin Patrick Weldon
*Attorney, Agent, or Firm*—Lowe, Price, Leblanc, Becker & Shur

[57] ABSTRACT

An atomizing apparatus comprises a body having a chamber into which liquid is supplied. A nozzle member is secured to the body to define a front vibrating member of said of the chamber, the nozzle member having at least one nozzle opening. A capacitive piezoelectric transducer is secured to the nozzle member for producing pressure rises in the liquid to cause the portion of the liquid in proximity to the nozzle opening to be ejected therethrough to the outside. The piezoelectric transducer is connected to an inductance element to form a resonant circuit. An amplifier is connected with the resonant circuit to form a self-oscillating loop to amplify the signal in the loop to sustain oscillation at a frequency variable as a function of the temperature-dependent capacitance of the piezoelectric transducer.

11 Claims, 15 Drawing Figures

ATOMIZING APPARATUS EMPLOYING A CAPACITIVE PIEZOELECTRIC TRANSDUCER

BACKGROUND OF THE INVENTION

The present invention relates to an atomizing apparatus for atomizing liquid such as liquid fuel, water, liquid drug, and recording medium.

Various proposals have hitherto been made in the field of liquid atomizers employing piezoelectric transducers. In one type of the prior art atomizers, as described in U.S. Pat. No. 3,738,574, there is provided a piezoelectric transducer which is secured to a vibrating element in the shape of a cone so that it amplifies the vibration generated by the transducer. Liquid is supplied to a plate attached to the apex of the hone where the vibration is at a maximum.

This prior art atomizing apparatus, however, requires that the vibrating element be manufactured in a close range of tolerance. Further, difficulties have been encountered in supplying the liquid to the vibrating element. A further disadvantage is that it requires a fairly large amount of power, specifically, a power output of 5 to 10 watts is needed to effect the atomization at a rate of 20 cc/min.

In ink jet printers, a typical example of which is described in U.S. Pat. No. 3,747,120, liquid is held in a chamber which is defined at the rearward end by a piezoelectric transducer to produce short duration pressure rises therein, the chamber being in comunication with a nozzle provided at the forward end. The liquid is ejected in the form of a jet at a considerably high speed to a writing surface in response to the short duration pressure rises. Although effective for printing purposes, this type of atomization is not operable with liquid of the type which contains a substantial amount of air such as kerosene since such resolved air tends to cause cavitation as the pressure rise advances through the bulk of the liquid from the rear to the front end of the liquid chamber.

Prior art driving circuits that generate a high frequency continuous wave include an oscillator and an amplifier that applies an amplified continuous wave voltage to the piezoelectric transducer. A typical example of such circuits is shown in FIG. 1 in which the frequency of an oscillator 2 is tuned to the resonant frequency of a piezoelectric transducer 1 to maximize its operating efficiency and applied thereto via an amplifier 3. However, with a change in ambient temperature the resonant frequency of the piezoelectric transducer deviates from the oscillator frequency. To compensate for such deviations a phase detector would be required to detect the difference in phase between the voltage and current of the signal applied to the piezoelectric transducer and provide a feedback signal to the oscillator so that the oscillator frequency closely follows the temperature dependent shift in the resonant frequency. In this case an oscillator of a variable frequency type is required.

Another prior art driving circuit employs a colpitz oscillator circuit as shown in FIG. 2 in which the piezoelectric transducer 1 is connected across the base and collector of a transistor 6 with a capacitor 4 being coupled between the base and emitter of that transistor and another capacitor 5 being coupled across the collector and emitter of the transistor. This circuit utilizes the piezoelectric transducer as an inductive component of the oscillator. Although the oscillator frequency follows the temperature variation, use of this type of oscillators is only limited to piezoelectric transducers having inductive property.

SUMMARY OF THE INVENTION

Accordingly, an object of the present invention is to provide an atomizing apparatus employing a capacitive piezoelectric transducer which is connected in a self-oscillating loop to be excited at a frequency which follows the temperature-dependent variation of the resonant frequency of the transducer.

Another object of the invention is to provide an atomizing apparatus which requires small power consumption and operates at high efficiency.

The atomizing apparatus of the present invention comprises a body having a chamber into which liquid is supplied. A nozzle member is secured to the body to act as a front vibrating member forming part of the chamber walls, the nozzle member having at least one nozzle opening. A capacitive piezoelectric transducer is secured to the nozzle member for producing pressure rises in the liquid to cause the portion of the liquid in proximity to the nozzle opening to be ejected therethrough to the outside. The piezoelectric transducer is connected to an inductance element to form a resonant circuit. An amplifier is connected with the resonant circuit to form a self-oscillating loop to sustain oscillation at a frequency variable as a function of the temperature-dependent capacitance of the piezoelectric transducer.

BRIEF DESCRIPTION OF THE DRAWINGS

The present invention will be described in further detail with reference to the accompanying drawings, in which.

DETAILED DESCRIPTION

Figure 3:
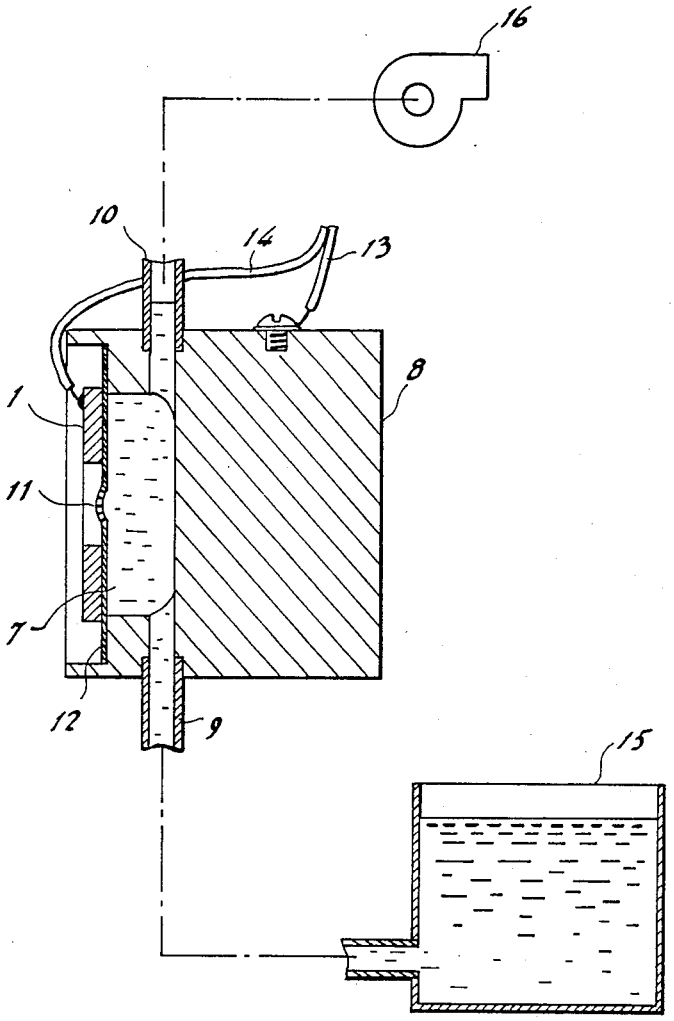
FIG. 3 is a cross-sectional view of the atomizing unit employed in the apparatus of the present invention.

Referring to FIG. 3, there is shown an atomizing unit which is particularly useful for the present invention. The atomizing unit includes a metallic body 8 having a liquid pressure chamber 7 into which the liquid is supplied through an inlet pipe 9 from a source 15. Illustrated at 12 is a nozzle member attached to the front periphery of the body 8 to serve as a front vibrating element while defining a portion of the liquid chamber 7. The nozzle member 12 is formed at the center thereof with a forwardly convexed, part-spherical portion 11 having a plurality of tiny nozzle openings which are oriented so that liquid droplets are expelled in diverging directions. Typically, the nozzle member 12 comprises a metal plate with a thickness of 30 to 100 micrometers and the nozzle openings have a diameter in the range between 30 to 100 micrometers. To the outside of the nozzle member 12 is secured a piezoelectric transducer 1 in the shape of a ring. The transducer 1 is provided with a conductive film, or electrode, on each of the opposide surfaces thereof, so that one electrode is electrically connected to the metallic body 8 which is in turn connected to an oscillator by a conductor 13 and the other electrode is connected by a conductor 14 to the oscillator. In a practical embodiment, the piezoelectric transducer 1 is preferably of a ceramic type which is polarized in the direction of its thickness. Typical dimensions of the piezoelectric transducer 1 are 0.5 to 2.0 millimeters in thickness, 5 to 15 millimeters in outer diameter and 2 to 5 millimeters in inner diameter. The perforated part-spherical portion 11 of the nozzle member is located in the center of the aperture of the ring-shaped piezoelectric transducer 1 as illustrated.

The liquid source 15 may be located at a position higher than the location of the atomizing body 8 so that the chamber 7 is constantly filled with liquid. However, any solid substances contained in the liquid tends to clog the nozzle openings. Preferably, the liquid source 15 is located at a position below the atomizer and a suction pump 16 is provided in communication with the liquid chamber 7 via an air vent pipe 10 for sucking liquid into the chamber 7 up to the position of the air vent pipe 10 prior to operation. The pump 16 is de-energized after operation to drain the liquid to leave the chamber 7 dry during nonworking periods to prevent the otherwise solid substances from clogging the nozzle openings.

The nozzle member 12 and piezoelectric transducer 1 form a bimorph construction so that they vibrate in unison in response to excitation pulses applied through the conductors 13, 14 to the piezoelectric transducer 1 and cause short duration pressure rises in the chamber 7. The portion of liquid which is located in close proximity to the part-spherical portion 11 is expelled through the nozzle openings in the form of atomized particles to the outside and diverge as they advance forward.

Figure 1:
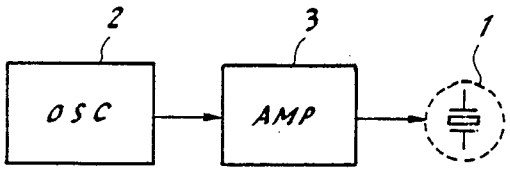
FIG. 1 PRIOR ART
FIG. 1 is a schematic illustration of a prior art atomizing apparatus.
Figure 2:
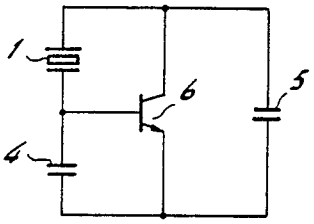
FIG. 2 PRIOR ART
FIG. 2 is a prior art oscillator circuit for atomizing apparatus employing an inductive piezoelectric transducer.
Figure 4:
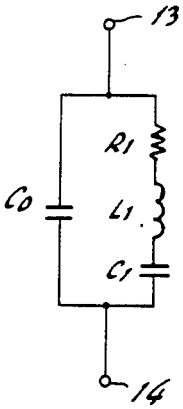
FIG. 4 is an equivalent circuit of the piezoelectric transducer of FIG. 3.
Figure 5:
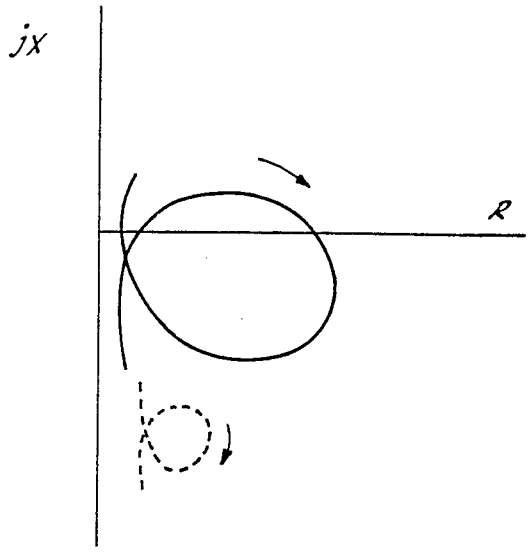
FIG. 5 is an illustration of a vector diagram of the piezoelectric transducer.
Figure 6:
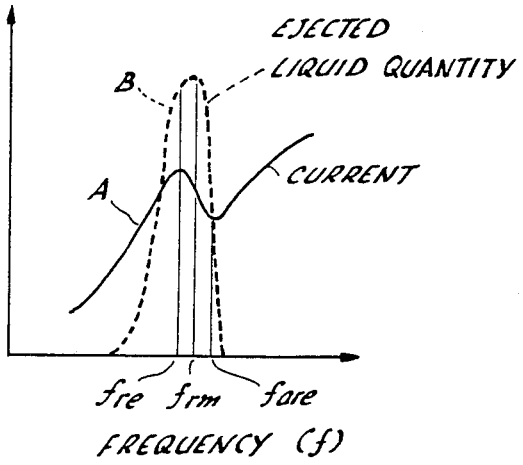
FIG. 6 is a graphic illustration of the operating characteristics of the apparatus of the invention.

FIG. 4 is an illustration of the equivalent circuit of the piezoelectric transducer 1 as assembled in the atomizer of FIG. 3. As shown, the piezoelectric transducer is represented by a capacitance $C_0$ which is in shunt with a series circuit including a resistance $R_1$, an inductance $L_1$ and a capacitance $C_1$. A variable frequency signal was applied to the piezoelectric transducer 1 to plot a vector diagram. As indicated by a broken-line curve in FIG. 5, the piezoelectric transducer 1 is capacitive in the full range of its operating frequencies when the chamber 7 is filled with liquid, whereas it showed an inductive nature as indicated by a solid-line curve when the chamber is vacant. Therefore, the capacitance $C_0$ can be considered a dominant factor of the piezoelectric transducer 1. A solid-line curve A in FIG. 6 indicates a plot of the current supplied to piezoelectric transducer 1 as a function of the frequency of the signal applied thereto. The supplied current was at a maximum when the frequency corresponds to an electrical resonant frequency $f_{re}$ which is slightly below the mechanical resonant frequency $f_{rm}$ and decreases to a minimum when the frequency approaches an electrical anti-resonance point $f_{are}$. As indicated by a broken-line curve B, the quantity of ejected liquid sharply increases to the maximum level when the frequency approaches the resonance frequency $f_{rm}$.

According to the present invention, the atomizing apparatus utilizes the capacitive property of the piezoelectric transducer 1 to form an oscillation loop so that its resonant frequency varies in response to temperature-dependent changes in the equivalent capacitance $C_0$, whereby the atomizer operates at maximum efficiency.

Figure 7:
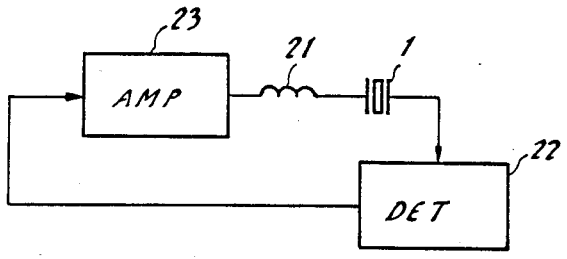
FIG. 7 is a block diagram of an atomizing apparatus according to an embodiment of the invention.

FIG. 7 is a first embodiment of the present invention in which the piezoelectric transducer 1 is connected in series with an inductor 21 to form a resonant circuit which is driven by an amplifier 23. This amplifier takes its input from the output of a voltage detector 22 whose input is connected to the piezoelectric transducer, thereby forming a self-oscillation loop having a resonant frequency given by $\frac{1}{2}\pi\sqrt{L_2 \cdot C_0}$, where $L_2$ is the inductance of inductor 21. The piezoelectric transducer 1 is thus operated at the resonant frequency of the oscillation loop which is variable with the capacitance value $C_0$ and hence it keeps track of the varying temperature.

Figure 8:
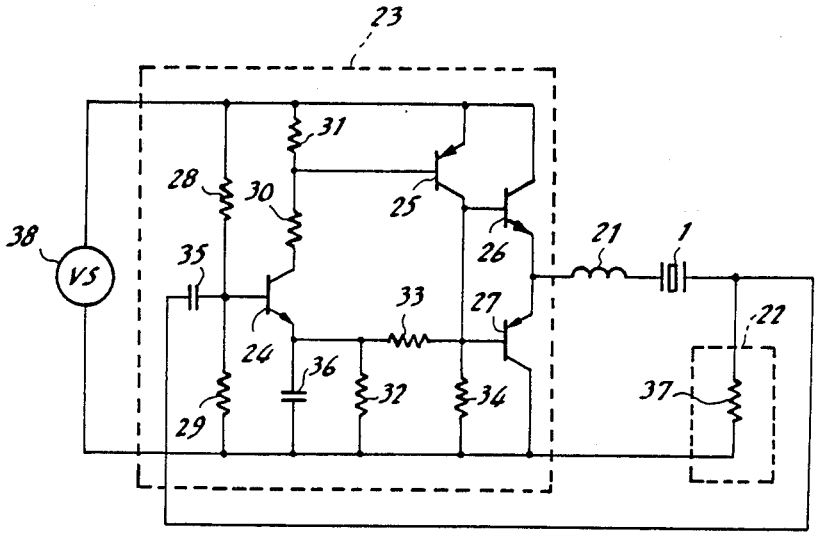
FIG. 8 is a circuit diagram illustrating the detail of FIG. 7.

A specific embodiment of the arrangement of FIG. 7 is shown in FIG. 8. The amplifier 23 is formed by an NPN transistor 24 which is biased by a voltage developed at a junction between resistors 28 and 29 which are connected in series across the terminals of a DC voltage source 38. The collector of transistor 24 is coupled by series-connected resistors 30 and 31 to the positive terminal of the voltage source 38 and the emitter of transistor 24 is coupled to the negative terminal of source 38 by a resistor 32 which is in shunt with a capacitor 36. A PNP transistor 25 has its emitter coupled to the positive terminal and its base coupled to a junction between the resistors 30 and 31. The collector of transistor 25 is coupled to a junction between resistors 33 and 34, which junction is coupled to the base of a transistor 27 whose emitter is connected to the emitter of a transistor 26 whose base is coupled to the collector of transistor 25.

The output of the amplifier 23 is taken from the junction between the emitters of transistors 26 and 27 and the input to the amplifier 23 is derived via a capacitor 35 from a resistor 37 coupled between the piezoelectric transducer 1 and the collector of transistor 27. The resistor 37 corresponds to the voltage detector 22. The voltage developed across the resistor 37 is amplified by the transistor 24 and drives the transistors 26 and 27 into switching action.

Figure 9:
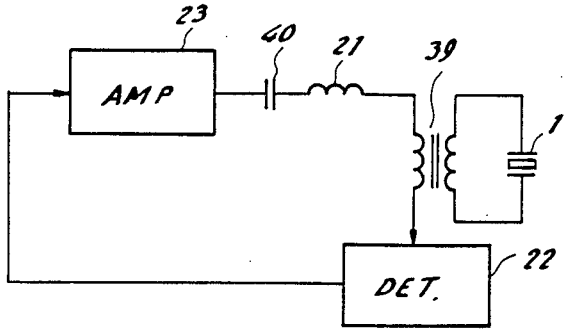
FIGS. 9 and 10 are block diagrams of modified embodiments of the invention employing a transformer.
Figure 10:
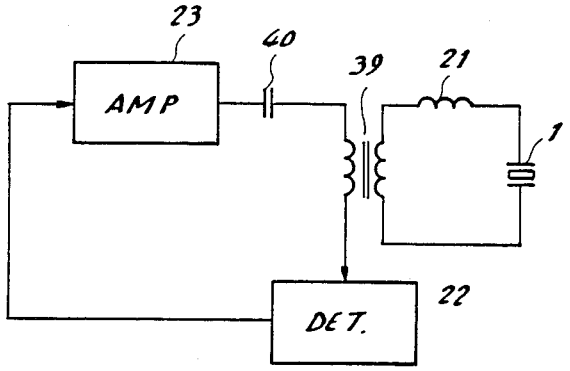

The invention allows the use of a transformer as illustrated in FIG. 9. As shown at 39 a transformer has a primary winding coupled between the inductor 21 and the voltage detector 22 and a secondary winding coupled across the terminals of the piezoelectric transducer 1. The transformer 39 has an appropriate value of stepup ratio so that it allows the amplifier 23 to be operated on a lower voltage which in turn allows a wide range of circuit elements to be used in circuit design. Since the transformer 39 serves to isolate the atomizer from the driving circuit, this embodiment is advantageous for applications in which the atomizer is combined with other electronic circuits in a common housing. Additionally, a DC decoupling capacitor 40 is interposed between the output of amplifier 23 and inductor 21 to prevent the generation of such a large DC current in the output stage of the amplifier 23 that the transformer 39 is saturated. The inductive element 21 of the resonant circuit may be connected in the secondary winding of the transformer 39 as illustrated in FIG. 10. This arrangement minimizes the effects of the transformer's leakage inductive and capacitive components on the resonant frequency of the oscillation loop.

Figure 11A:
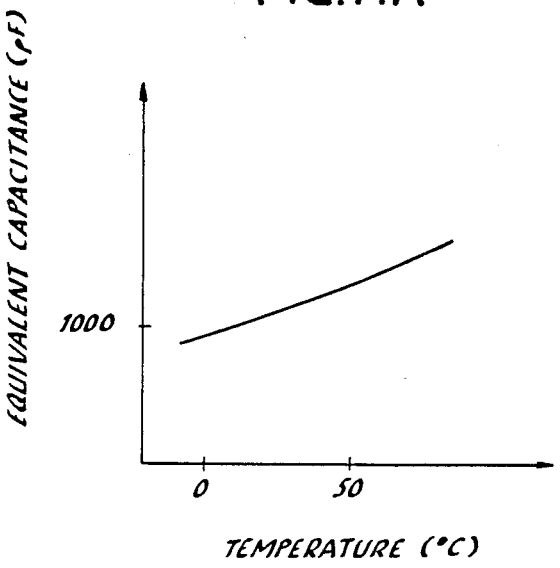
FIGS. 11A and 11B are graphic illustrations of the temperature-dependent operating characteristics of the apparatus of FIGS. 7 to 10.
Figure 11B:
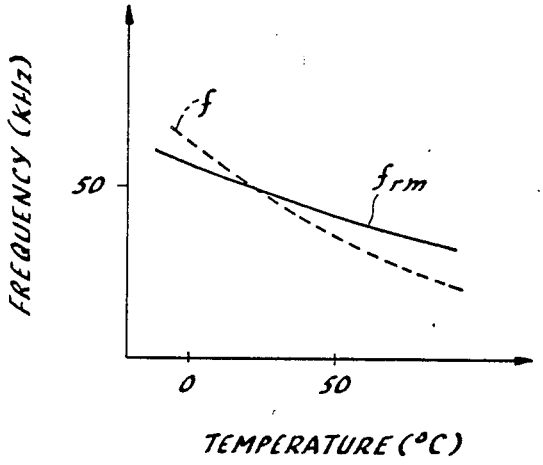

It was observed that, even if the oscillator frequency is tuned to the mechanical resonance $f_{rm}$ of the piezoelectric transducer 1, a combined effect of the temperature-dependent inductive variation of the inductor 21 and that of the capacitive component $C_0$ tends to cause the oscillator frequency f to deviate with respect to the temperature-dependent mechanical resonance $f_{rm}$ of the piezoelectric transducer 1 and as a result the atomizer operates at a point off the maximum efficiency. FIG. 11A illustrates the temperature-dependent variation of the capacitive component $C_0$ which increases with temperature, and FIG. 11B illustrates the temperature-dependent variations of the oscillator frequency f and mechanical resonance $f_{rm}$. As indicated, the oscillator frequency f is higher than the desired point when temperature is relatively low and becomes lower than the latter as temperature increases.

Figure 12:
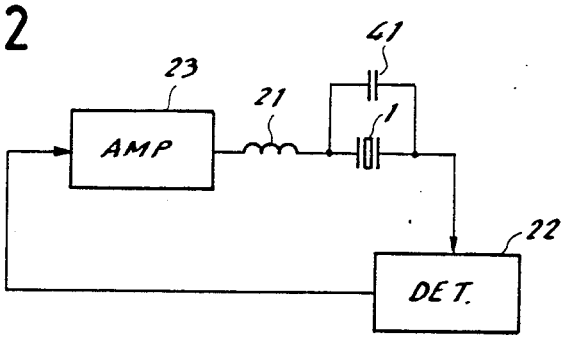
FIGS. 12 and 13 are block diagrams of further modifications of the invention employing a compensating capacitor.
Figure 13:
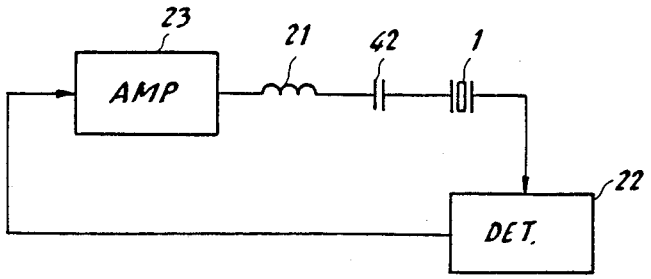

FIG. 12 shows one embodiment of the present invention which compensates for the deviation of the oscillator frequency from the desired value. In this embodiment, a capacitance $C_2$ at 41 is coupled in parallel with the piezoelectric transducer 1 in the arrangement of FIG. 7. The resonant frequency of this modified oscillator circuit is given by $\frac{1}{2}\pi\sqrt{L_2(C_0+C_2)}$. By appropriately determining the capacitance $C_2$ it is possible to conform the oscillator frequency f to follow the solid-line curve of FIG. 11B by reducing the varying rate of the frequency f. Alternatively, a capacitance $C_3$ at 42 may be connected in series with the piezoelectric transducer 1 as shown in FIG. 13. The embodiments of FIGS. 12 and 13 are advantages if the magnitude of the temperature-dependent variation of inductor 21 is much smaller than that of the equivalent capacitance $C_0$ of the piezoelectric transducer 1.

Figure 14:
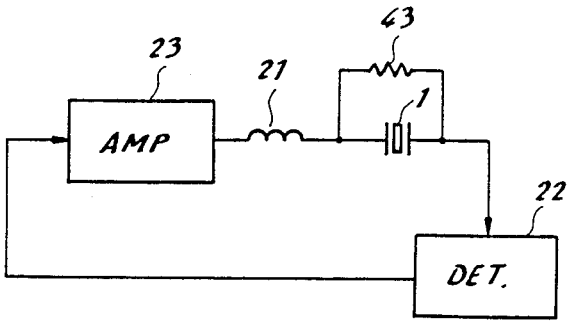
FIG. 14 is a block diagram of an atomizing apparatus having a resistor coupled across the piezoelectric transducer.

A further modification of the invention is illustrated in FIG. 14 in which a resistor 43 is connected in parallel with the piezoelectric transducer 1. This arrangement is advantageous in that it reduces the effect of a leakage path which might occur across the opposed electrodes of the piezoelectric transducer 1 due to a loss of insulation under humid environment. In this embodiment, the inductor 21 is so chosen as to take the resistor 43 into account in determining the oscillator frequency f. Such leakage paths are coupled in parallel with the resistor 43 to provide a combined resistance value which would not materially alter the resonant frequency of the tank circuit.

Although it is theoretically ideal to operate the piezoelectric transducer at the mechanical resonance $f_{rm}$, the oscillation becomes unstable as the oscillator frequency almost corresponds to the resonant frequency $f_{rm}$. To avoid this instability one approach would be to provide a loose coupling between the output stage of the amplifier 23 and the piezoelectric transducer 1. However, this would add to the structural complexity. A preferred approach is to operate the piezoelectric transducer 1 at a frequency a few hundreds Hz below the electrical resonant frequency $f_{re}$.

The foregoing description shows only preferred embodiments of the present invention. Various modifications are apparent to those skilled in the art without departing from the scope of the present invention which is only limited by the appended claims. Therefore, the embodiments shown and described are only illustrative, not restrictive.

What is claimed is:

1. An atomizing apparatus comprising:

a body defining a chamber for holding liquid therein;

means for supplying the liquid into said chamber;

a nozzle member secured to said body as a front vibrating member defining part of the wall of said chamber, said nozzle member having at least one nozzle opening;

a capacitive piezoelectric transducer secured to said nozzle member for producing pressure rises in said liquid to cause the portion of the liquid which is in proximity to said nozzle opening to be ejected therethrough to the outside;

a resonant circuit including an inductance element and said piezoelectric transducer; and an amplifier connected with said resonant circuit to form a self-oscillating loop therewith for amplifying the signal in said loop.

2. An atomizing apparatus as claimed in claim 1, wherein the output of said amplifier is applied through said inductance element to said piezoelectric transducer.

3. An atomizing apparatus as claimed in claim 1, further comprising a transformer arranged to couple the output of said amplifier to said piezoelectric transducer.

4. An atomizing apparatus as claimed in claim 3, further comprising a DC decoupling capacitor connected between the output of said amplifier and said transformer.

5. An atomizing apparatus as claimed in claim 4, wherein the output of said amplifier is coupled through said DC decoupling capacitor to a primary winding of said transformer and said resonance circuit is coupled to a secondary winding of said transformer.

6. An atomizing apparatus as claimed in claim 1, further comprising means for compensating for the deviation of the frequency of said oscillating loop from an inherent resonant frequency of said piezoelectric transducer which varies as a function of temperature.

7. An atomizing apparatus as claimed in claim 6, wherein said compensating means comprises a capacitor coupled in parallel with said piezoelectric transducer.

8. An atomizing apparatus as claimed in claim 6, wherein said compensating means comprises a capacitor coupled in series with said piezoelectric transducer.

9. An atomizing apparatus as claimed in claim 1, further comprising a resistor coupled in parallel with said piezoelectric transducer.

10. An atomizing apparatus as claimed in claim 1, wherein the frequency of said self-oscillating loop is below an inherent resonant frequency of said piezoelectric transducer.

11. An atomizing apparatus as claimed in claim 1, wherein said self-oscillating loop further includes means for detecting a signal developed in said piezoelectric transducer, the input of said amplifier being connected to said detecting means to amplify said detected signal for application to said inductive element.

* * * * *